United States Patent [19]

Boisseau

[11] Patent Number: 4,807,428

[45] Date of Patent: Feb. 28, 1989

[54] PACKING MACHINE FOR AMERICAN BOXES

[75] Inventor: Jean-Louis Boisseau, Sainte Savine, France

[73] Assignee: Vega Automation, France

[21] Appl. No.: 49,472

[22] Filed: May 14, 1987

[30] Foreign Application Priority Data

May 16, 1986 [FR] France ..... 86 07096

[51] Int. Cl.[4] ..... B65B 43/24

[52] U.S. Cl. ..... 53/563; 53/247; 53/564; 53/282; 493/479

[58] Field of Search ..... 53/566, 247, 564, 282; 493/479

[56] References Cited

U.S. PATENT DOCUMENTS

| | | | |
|---|---|---|---|
| 2,280,773 | 4/1942 | Ferguson . | |
| 3,164,938 | 1/1965 | Waite . | |
| 3,611,884 | 10/1971 | Hottendorf | 493/479 X |
| 4,150,523 | 4/1979 | Gentilei | 53/281 |
| 4,163,414 | 8/1979 | Bachman, Jr. et al. . | |
| 4,233,798 | 11/1980 | Helding . | |
| 4,604,083 | 8/1986 | Barney | 493/479 X |

FOREIGN PATENT DOCUMENTS

| | | |
|---|---|---|
| 505317 | 9/1951 | Belgium . |
| 142007 | 5/1985 | European Pat. Off. . |
| 871420 | 7/1949 | Fed. Rep. of Germany . |
| 2702481 | 7/1978 | Fed. Rep. of Germany . |
| 2754057 | 8/1978 | Fed. Rep. of Germany . |
| 3417508A1 | 11/1985 | Fed. Rep. of Germany . |
| 2029300 | 10/1970 | France . |
| 535347 | 4/1941 | United Kingdom . |
| 1033743 | 11/1963 | United Kingdom . |
| 2079715A | 1/1982 | United Kingdom . |

*Primary Examiner*—John Sipos

*Attorney, Agent, or Firm*—Mason, Fenwick & Lawrence

[57] ABSTRACT

A packing machine for American boxes comprising apparatus for supplying empty boxes, apparatus for supplying the contents of the box in batches, apparatus for transferring the batches and placing them in open boxes, and apparatus for discharging the boxes. The apparatus for supplying the empty boxes bears a magazine of folded box blanks and apparatus for opening and erecting the box and forming the bottom thereof.

30 Claims, 10 Drawing Sheets

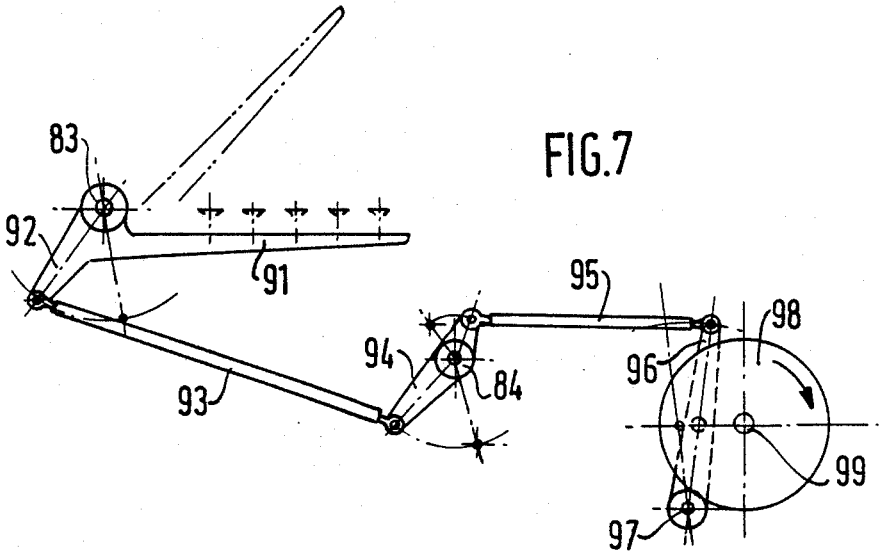
FIG.7
FIG.8
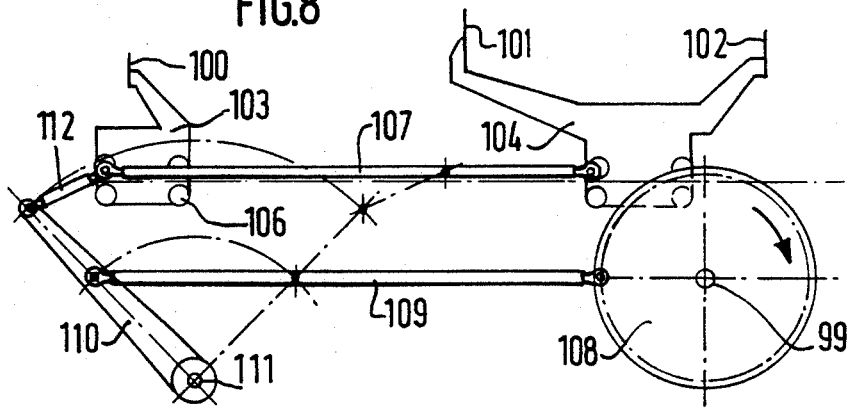
FIG.9
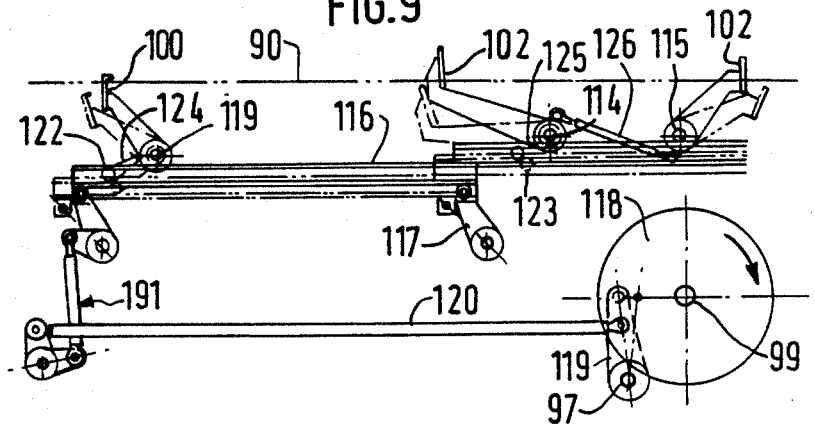

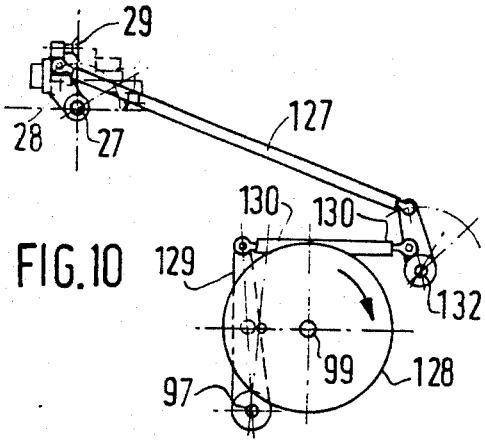
FIG.10
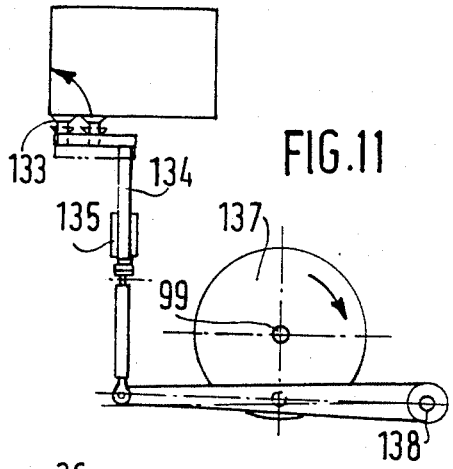
FIG.11
FIG.12
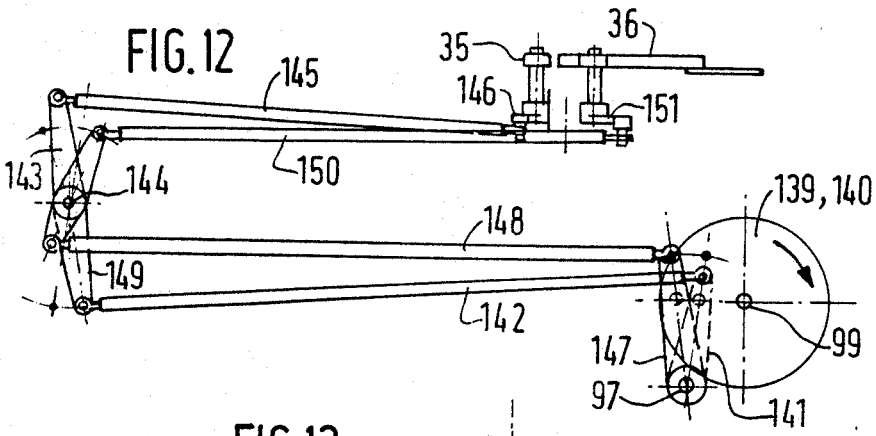
FIG.13
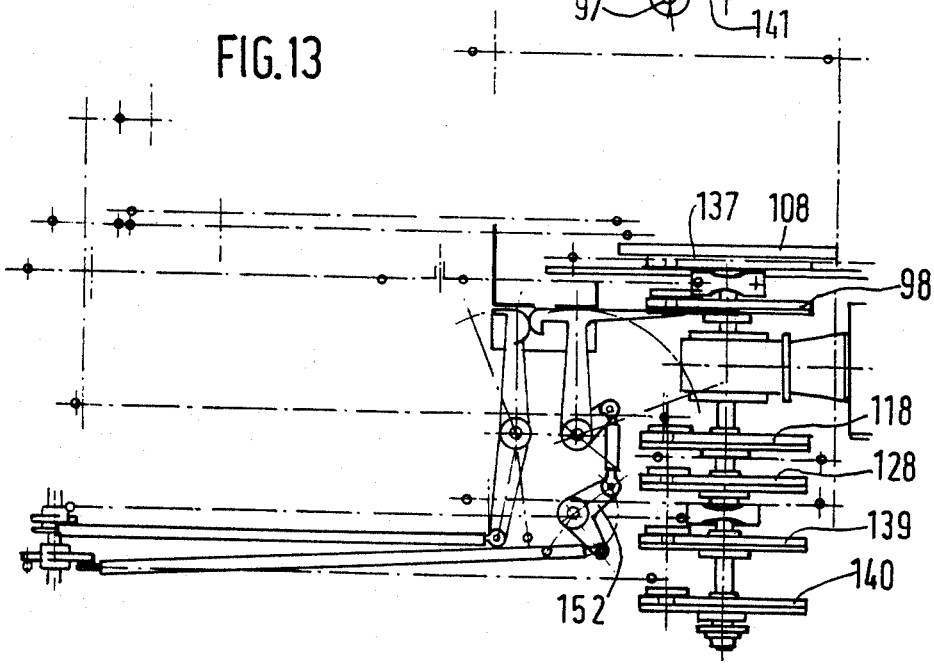

PACKING MACHINE FOR AMERICAN BOXES

The invention relates to a packing machine for American boxes.

Already there are a number of known packing machines for American boxes, comprising empty-box supply means bearing, in the upstream-downstream direction, a magazine of folded-flat, stacked box blanks and means for opening and erecting the box and forming the bottom thereof by folding and securing the flaps for making it up; means for supplying the contents of the box in batches suitable for packing; means for transferring the batches of contents and placing them in the boxes, which are opened and prepared for the purpose, the means being inserted between the downstream end parts of the empty-box supply means and the batch supply means; and box discharging means bearing, in the upstream-downstream direction, the batch transfer means and the means for forming the box lid by folding and securing the flaps for making it up.

Improvements made to the known machines have mainly concentrated on higher reliability, better synchronisation of the motion of the various moving parts therof, higher production rates, and new opening or folding devices (see inter alia documents U.S. Pat. Nos. 4,163,414, 2,280,773 and FR No. 2 029 300). It is also known to use maintenance robots (document DE No. 2 702 481) and numerous variants of the various means for making up the aforementioned packing machines in general (documents DE No. 2 754 057, BE No. 5050 317, DE No. 871 420, GB No. 2 079 715, GB No. 535 347, DE No. 3 417 508, GB No. 1 033 743, U.S. Pat. Nos. 4,233,798 and 3,164,938).

Known packing machines can be used for various sizes of box by manually adjusting the various adjustment or operating parameters of the machine. This adjustment requires some skill on the part of the operator and also takes time during which the machine remains idle. These disadvantages have been accepted, since changes in size have been infrequent and the adjustment time was considered inevitable in view of the mechanical adjustment means used.

It has been proposed (document EP No. 0 142 007) that the components of a packing machine should be movable by adjustment screws successively coupled to portable movable drive means. Each component is successively brought by the drive means to a reference position and then moved therefrom to the desired final position. The drive means are of the kind comprising a manually-controlled motor unit such as those used for manual electric tools (drills, sanders, etc). Owing to their structure, the proposed adjustment means are limited to a small number of means having short travel. The device requires effective access to the adjusting screws for coupling the drive means. Finally, successive adjustment of the components increases the total adjustment time. In the device, the different components are adjusted independently. Consequently the machine has prohibitive disadvantages if changes of size become more frequent and cover a wider range and if the users want to improve the productivity of the machine by reducing idle times.

The invention therefore aims to solve the problem of flexibility of operation of packing machines for American boxes with reference to the various sizes of boxes used, without requiring special expertise from the user or appreciable loss of time.

To this end, in a packing machine for American boxes according to the invention, of the general kind mentioned hereinbefore, the means for opening and erecting the box and forming the bottom thereof and the means for making up the lid are mounted so as to be slidable but lockable on shafts and are moved along the shaft by drive means permanently incorporated in the machine and associated with digital control means, at least some of the means forming the machine being movable simultaneously.

The machine according to the invention is constructed so that it is particularly easy and quick to operate with reference to the various sizes of American boxes under consideration.

The packing machine according to the invention, in contrast to the prior art more particularly as illustrated by documents U.S. Pat. No. 2,280,773 and EP No. 0 142 007, has the feature that the machine is specifically designed to permit adjustments for change of size, the various components of the machine being adjusted in combination with one another and mainly and at least partially simultaneously with the drive means, which form an integral part of the machine, constitute a fixed assembly and act simultaneously on the various components. By contrast, the machine according to document EP No. 0 142 007 does not have a general structure particularly adapted for adjustment as aimed at by the invention, but starts from a conventional machine construction and simply enables some of its parts to be adjusted without combining the various adjustments and without incorporating the means for driving the machine.

The other features of the invention will be clear from the following description with reference to the accompanying drawings in which:

FIGS. 7, 8, 9, 10, 11, 12 are six diagrammatic views in partial elevation illustrating the mechanical elements for operating the machine;

FIG. 13 is a top view illustrating the mechanism;

Figure 1:
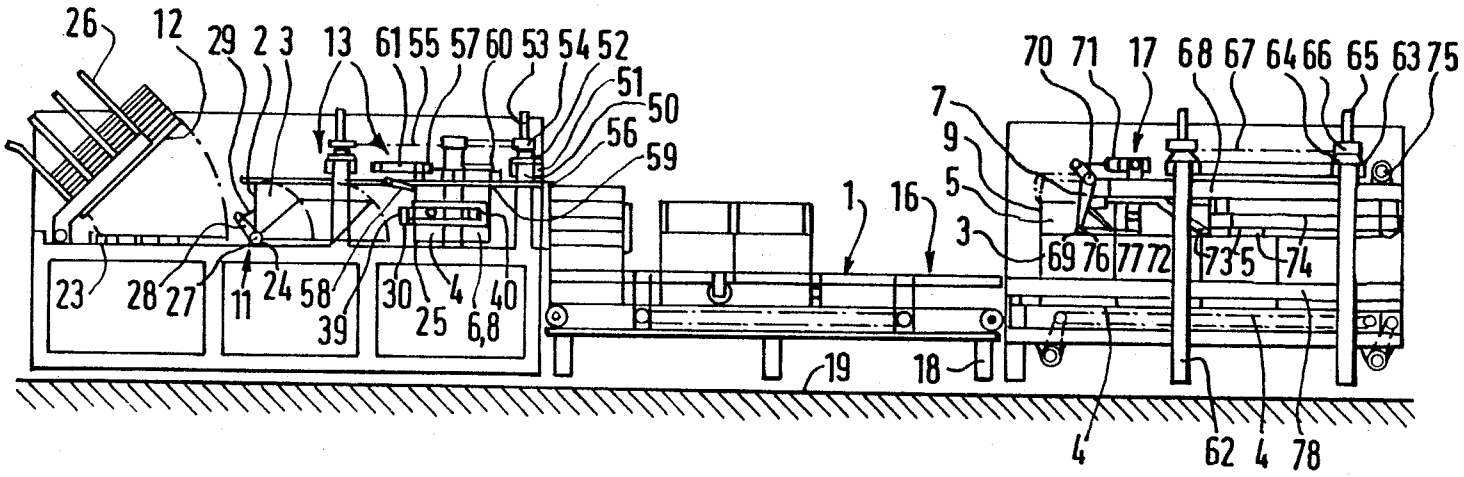
FIG. 1 is a diagram in elevation of a basic embodiment of a packing machine according to the invention, illustrating the means which it constitutes.

The invention relates to a packing machine 1 for American boxes 2.

An American box 2, also known as a regular slotter case, is known per se and has four sides 3, a bottom 4 and a lid 5. The bottom 4 and lid 5 are each made up of two first flaps 6, 7 respectively and two second flaps 8, 9 respectively. Two first flaps 6, 7 and two second flaps 8, 9 are adjacent to opposite sides 3 respectively. At the start, box 2 forms a flat blank, the sides 3 being bent on one another and the flaps 6, 7, 8, 9 projecting and being situated in the same plane as the sides 3.

The packing machine 1 is also intended for a contents 10 formed into separate batches for packing into successive American boxes when they have been erected and opened.

The packing machine 1 firstly comprises means 11 for supplying empty boxes and bearing, in the upstream-downstream direction, a magazine 12 of folded, stacked, box blanks and means 13 for opening and erecting the box 2 and forming the bottom 4 thereof by folding and securing the flaps 6, 8.

Secondly, the packing machine 1 comprises means 14 for supplying the contents 10 in batches suitable for packing.

Thirdly the packing machine 1 comprises means 15 for transferring batches of contents 10 and placing them in boxes 2, which have been opened and prepared for the purpose, the means being interposed between the downstream end parts of the supply means 11 and the supply means 14.

Fourthly, the packing machine 1 comprises means 16 for discharging the boxes and bearing, in the upstream-downstream direction, the aforementioned transfer means 15 and means 17 for making up the lid 5 by folding and securing the flaps 7, 9 for making it up.

The term "upstream" and "downstream" are with reference to the direction of motion of the conveying means (supply or discharge), i.e. the empty boxes for the supply means 11, the batches of contents 10 for the supply means 14 and the boxes 2 and batches of contents 10 for the discharge means 16.

Stacks of box blanks 2 and batches of contents 10 are disposed at the machine inlet. Boxes filled with batches of contents and closed are disposed at the outlet.

According to a feature of the invention, the machine should be considered in its totality or only partially (e.g. with regard to the erecting part). Machine 1 is borne by a frame 18 resting on a usually horizontal bearing surface 19 (the ground). The supply means 11, 14 and the discharge means 16 usually extend horizontally. More particularly the discharge means 16 are disposed substantially in line with the means 11 for supplying empty boxes, and the means 14 for supplying the contents are disposed alongside the discharge means 16, though operating in the opposite direction.

The means 13 for opening and erecting the box 2 and making up the bottom 4 thereof and the means 17 for making up the lid 5 are slidably but lockably mounted on shafts and moved along the shafts by drive means associated with digital control means (not shown). The digital control means also actuate the other components of the machine.

According to important features of the invention, the machine 1 is in general designed to be adjustable as a whole, since the shafts on which the machine components are slidably but lockably mounted are an integral part of the machine instead of being added to a known basic structure. The shafts are designed so that the various components can be moved and adjusted in combination and at least partially simultaneously. The drive means are also incorporated in machine 1 and form a fixed assembly and are at least partly common to the various shafts or components. The shafts and/or the drive means and/or the machine components may or may not be accessible, since accessibility is not a critical condition for adjustment.

The drive means preferably comprise threaded rods driven in rotation by one or more motors. Other equivalent embodiments of the drive means can be considered (e.g. linear motors or jacks). As described hereinafter, at least some of the threaded rods extend transversely across the machine 1 and are borne by frame 18 and, in at least some cases, are threaded in opposite directions. This feature illustrates the manner in which the aforementioned adjusting means are integrated and shows that the adjustment range can be particularly wide.

The control means comprise manual means for displaying the size of the boxes 2 to be constructed and filled, and also comprise a programmable automatic unit associated with the manual display means and the drive means so that, depending on the adjustment of the manual display means, the programmable automatic unit moves the drive means so as to bring means 13, 17 into the positions corresponding to the chosen size. The various components are thus adjusted automatically, in combination and at least partially simultaneously.

The manual display means (not shown) can comprise one or more buttons movable on one or more dials marked with the various possible sizes.

For example the dials show the length, width and height of the boxes, which can inter alia vary respectively between 150 and 450 mm, 100 and 300 mm and 190 and 500 mm. The machine can be adjusted either continuously or discontinuously by the display means.

The programmable automatic unit can comprise suitable electronic units such as a memory or microprocessor.

According to another feature of the invention, taken separately or in combination with the other features, the means 15 for transferring batches of contents 10 comprise a robot having three degrees of freedom (one vertical axis and two horizontal axes) so that boxes 2 can be filled with batches of contents 10 either vertically or from the side. Consequently the packing machine according to the invention is multi-purpose and can be of the vertical or the lateral packing kind, depending on how the transfer means 15 are actuated.

The transfer means 15 (not shown in FIG. 1) comprise stationary bearing means 20 associated with frame 18 and a number of arms 21 borne by means 20 and moved by drive means such as jacks or motors and ending in gripping means 22 adapted to grip a batch of contents 10. The gripping means 22 can be mechanical or pneumatic and inter alia can comprise suckers associated with a suction device. The gripping means 22 comprise e.g. a movable suction head or matrix comprising one or more lines and one or more rows of suckers.

The supply means 11 comprise holding and guide means associated with frame 18 and intended for movable lugs for driving the boxes 2, which are moved by drive means such as endless chains driven by one or motors (not shown).

The supply means 11, inter alia the movable lugs for driving the boxes 2, define a reference axis for each box 2, i.e. the upstream bottom horizontal edge of box 2 in the present case.

The reference axis can also occupy a number of fixed reference positions along the supply means 11, i.e. a first upstream initial position 23, a second intermediate opening position 24 and a third final position for making up the bottom 25. Positions 23, 24, 25 are preferably equidistant from one another.

The means 13 for opening, erecting and forming the bottom 4 are adjusted with reference to the fixed positions 23, 24 and 25.

The magazine 12 is disposed opposite the first position 23. It comprises a number of guide rails 26 adapted to keep the box blanks folded, superposed and inclined at e.g. about 45° to the supply means 11. If required, magazine 12 is adjustable to various box sizes or is movable and can be replaced by another magazine corresponding to another size, or alternatively a number of magazines are placed side by side, each adapted to one size, the various magazines being mounted on drive means (such as a threaded rod and motor) associated with the previously-mentioned digital control means.

In all cases, the means forming the magazine 12 are preferably adjustable automatically by one or more digitally-controlled shafts.

Means (not shown in detail) are adapted to transfer the blanks from store 12 to the supply means 11. They can be of the kind comprising a movable arm and sucker driven by one or more motors and by a rod-and-crank or cam system.

A horizontal, transverse shaft 27 is disposed at the second intermediate position 24 and pivotably bears an arm 28 terminating in one or more suckers 29 which can be attached from above to the side 3 adjacent the reference axis so as to open the box 2. If required another movable sucker (not shown) is provided in combination for pressing underneath on to the side adjacent the reference axis.

Two horizontal lateral longitudinal members 30 are disposed approximately between the second intermediate position 24 and the downstream end of the supply means 11 and are situated on either side of the supply means and slightly above the plane thereof. Members 30 are movable horizontally and transversely but can be adjustably locked in position by the digital control means. They extend parallel to and on either side of the supply means 11 and have horizontal transverse threaded bearings 31. The packing machine 1 also comprises at least two horizontal transverse threaded rods 32 threaded in opposite directions at their two ends and cooperating with the coaxial threaded bearings 31 of the two longitudinal members 30. Rods 32 are disposed below the supply means 11 so as not to interfere with boxes 2. Horizontal transverse bearings 33 for the threaded rods 32 are disposed in frame 18. At least one driving motor (not shown) drives the threaded rods 32 synchronously in rotation via chains 34 or the like and thus moves and adjusts the position of members 30.

Members 30 have e.g. in transverse right cross-section a right-angled shape on a vertical arm of which are situated the bearings 31 and on the horizontal arm of which the previously-described components rest.

The first longitudinal member (i.e. the member on the right in FIG. 2 relative to the direction of advance of boxes 2) bears firstly, in the upstream-downstream direction, two arms 35, 36 extending in a horizontal plane pivoting around vertical shafts 37, 38 and adapted to fold the first two flaps 6 of bottom 4 at the outside of box 2. Secondly, the first longitudinal member 30 bears horizontally-placed sticking means 39 directed towards the central vertical plane of machine 1. The sticking means 39 cooperate with the first flaps 6, which are folded by arms 35 and 36. Finally and thirdly, member 30 bears a vertical longitudinal plate 40 via a transverse jack 41. Plate 40 slides in the horizontal transverse direction and is adapted to fold the second flaps 8 of bottom 4, on the outside of box 2.

The second longitudinal member 30 (on the left in FIG. 2) bears movable means 42 opposite plate 40, so as to cooperate with the first flaps 6 inside the box 2.

Figure 2:
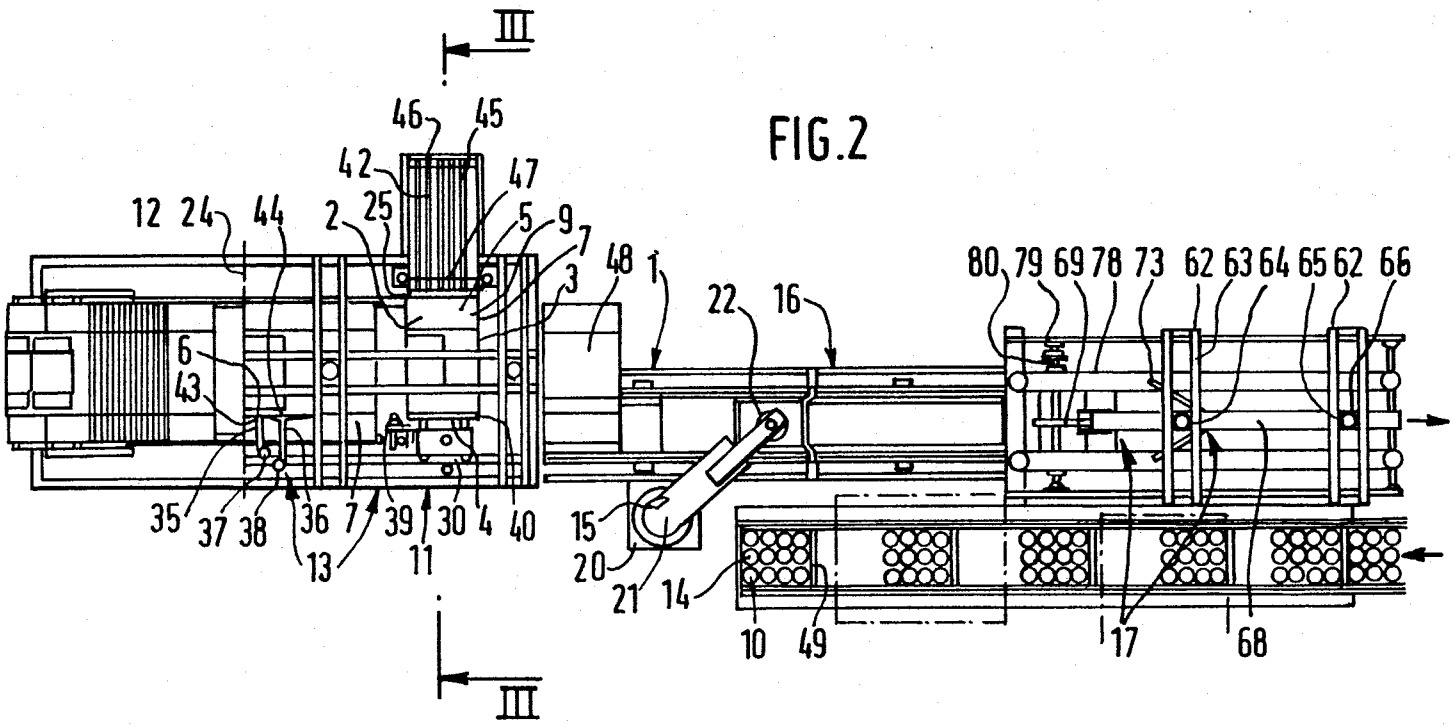
FIG. 2 is a diagrammatic partial top view of the packing machine shown in FIG. 1.

Arms 35, 36 are movable between a retracted position (not shown) in which they extend towards the exterior of the machine at a distance from the supply means 11 and the boxes 2, and an operating position where their respective bearing planes 43, 44 are coplanar in the plane of the bottom 4 (FIG. 2). This is the same plane containing the nozzle of the sticking means 39 and the plate 40 in a front external position.

Plate 40 is movable between two end positions, i.e. a front end working position as previously mentioned and a rear end position which is retracted, at a distance from bottom 4 and a greater distance from the supply means 11.

In the operating position, the upstream end position of the bearing plane 43 of the upstream arm is disposed in or near the second reference position 24. The upstream edge of plate 4 is disposed at or near the third reference position 25. The sticking means 39 are disposed slightly upstream of plate 40 so as not to interfere with it.

The cooperating means 42 according to the invention comprise a number of juxtaposed jacks 45 formed into a matrix having one or usually a number of lines (FIG. 2) and one or usually a number of columns (FIG. 3), the jacks 45 being borne by a vertical longitudinal plate 46 at a distance from the supply means 11 and rigidly associated with the second longitudinal member 30. Each jack 45 has a rod ending in an elementary cooperating plate 47. Jacks 45 are actuated by the previously-mentioned control means so that only some of the jacks are operative, i.e. those whose elementary plates 45 can extend into the box 2 in question.

Figure 4:
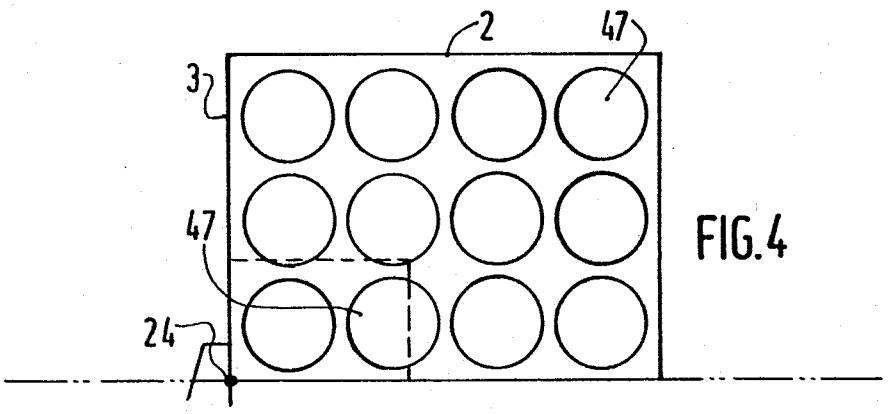
FIG. 4 is a diagram in section along line 4.4 of FIG. 3 illustrating two possible variants and different sizes.
Figure 5:
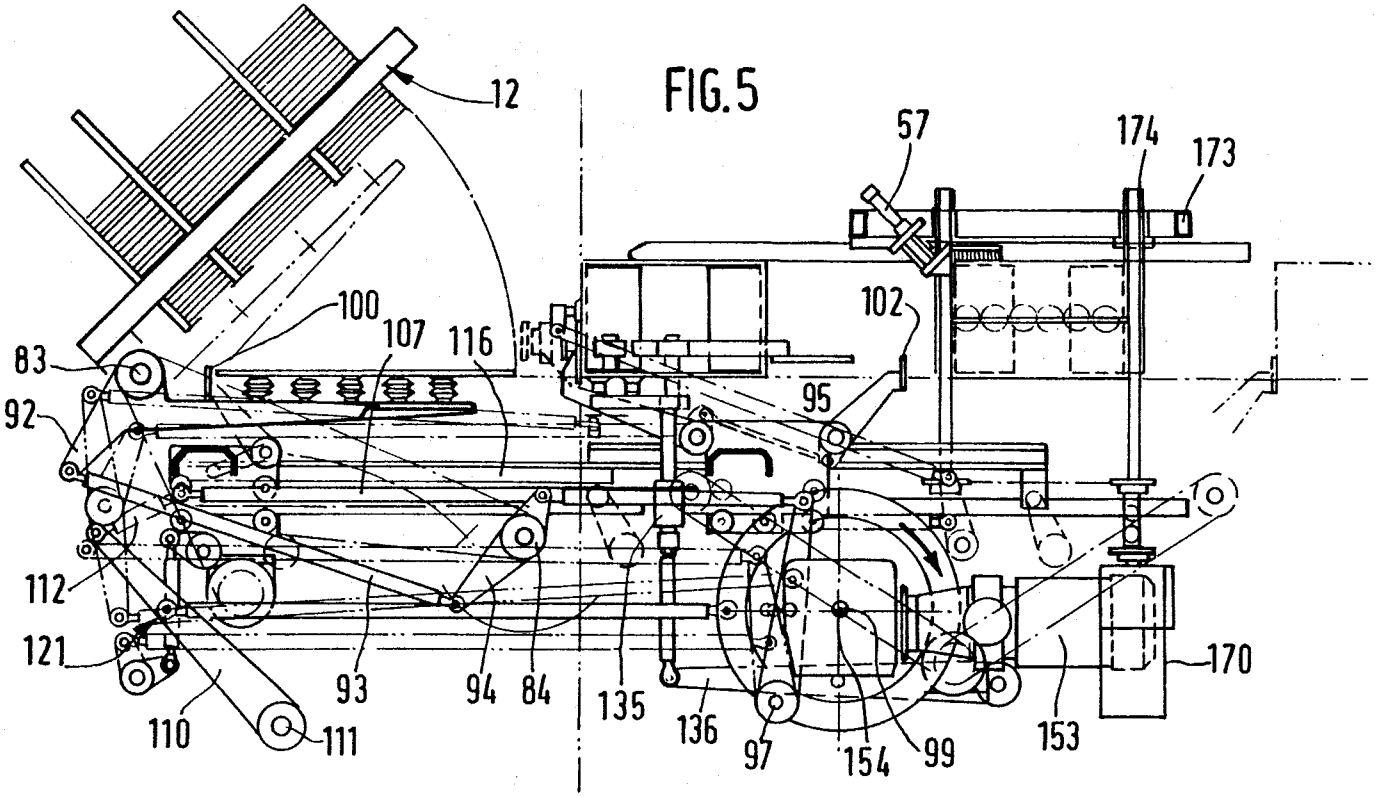
FIG. 5 is a side view and FIG. 6 is a top view of another embodiment of the machine, with reference to the part for erecting the box.
Figure 6:
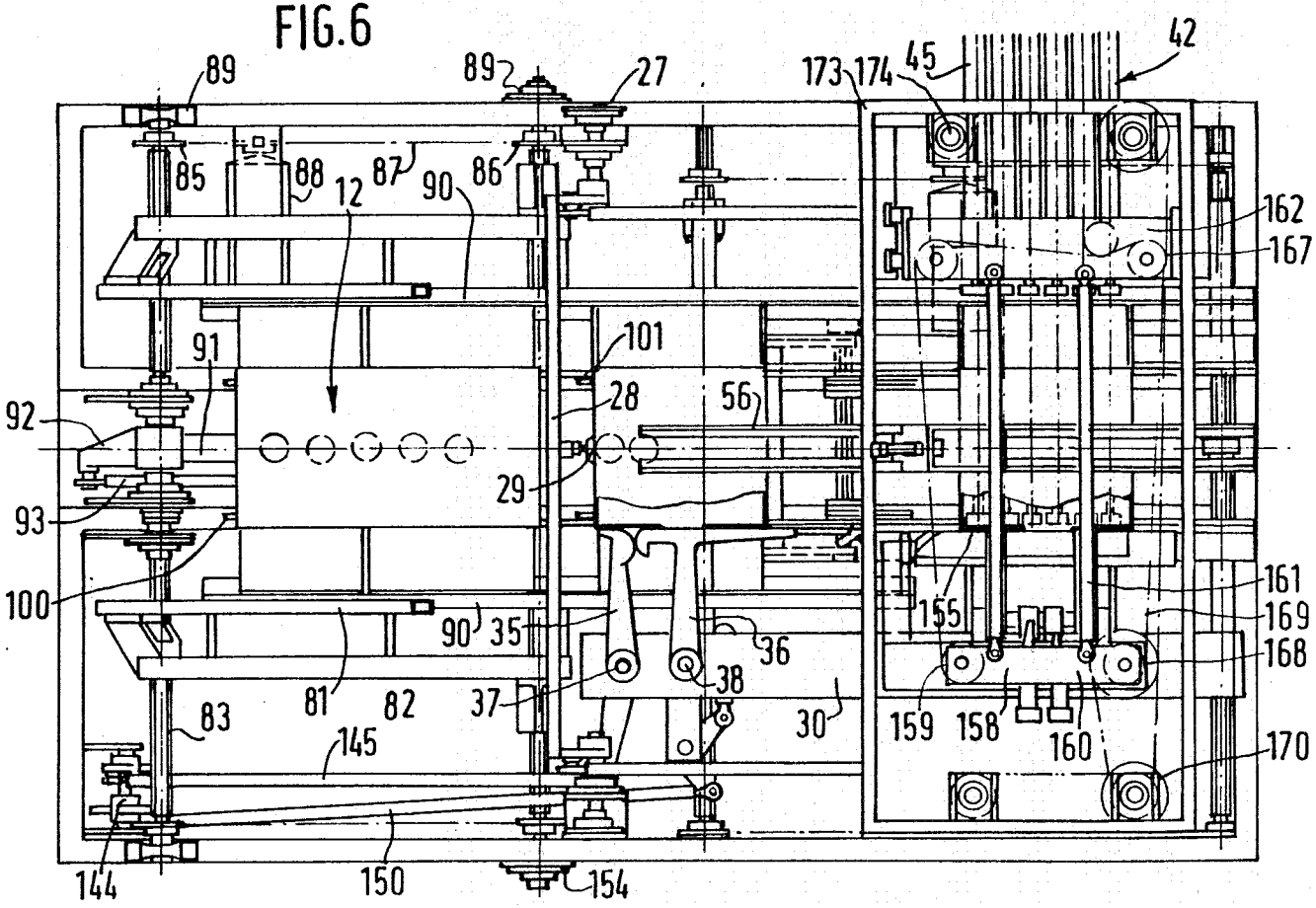
Figure 14:
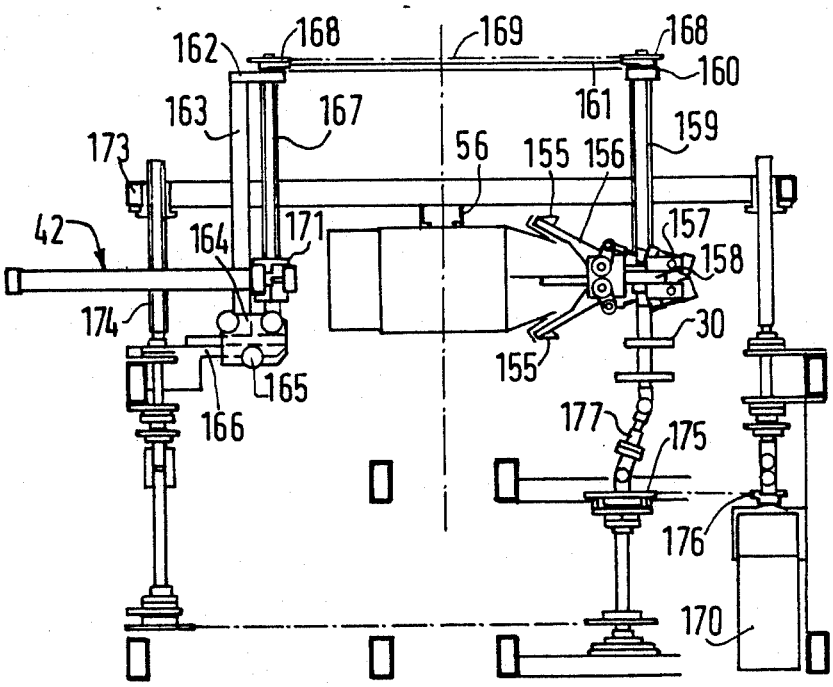
FIGS. 14 and 15 are two diagrammatic front views of the means for forming the bottom of the box.
Figure 15:
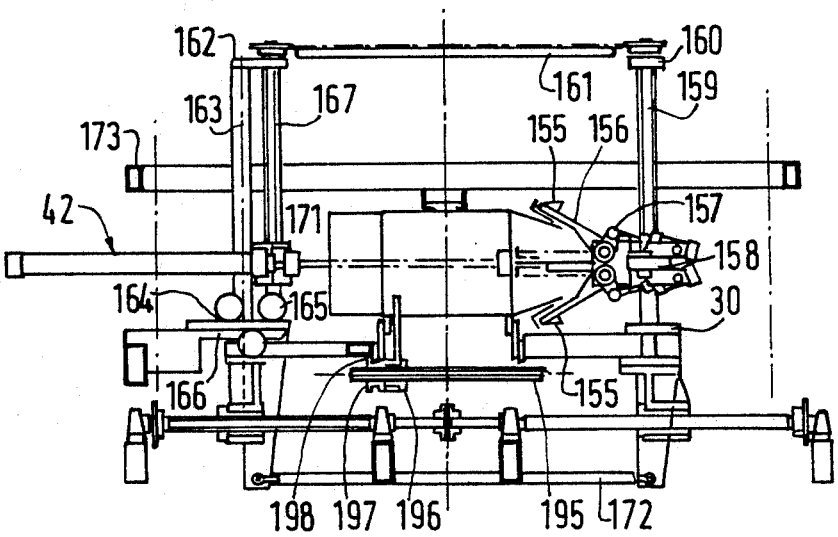
Figure 16:
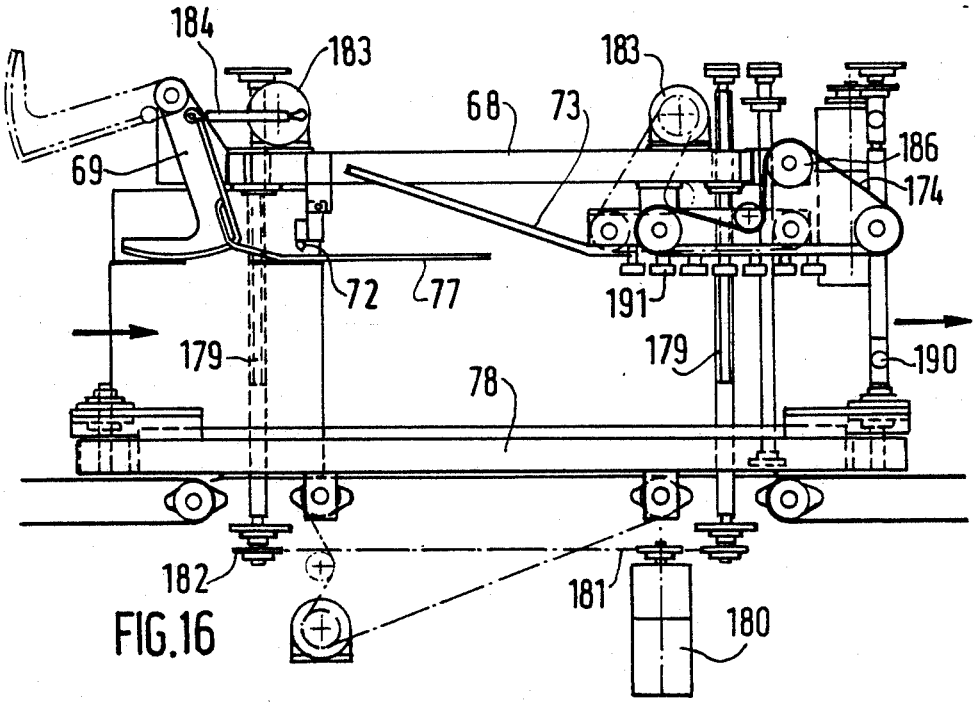
FIGS. 16, 17, 18, 19 are side, top and front views respectively illustrating the discharge part of the machine.
Figure 17:
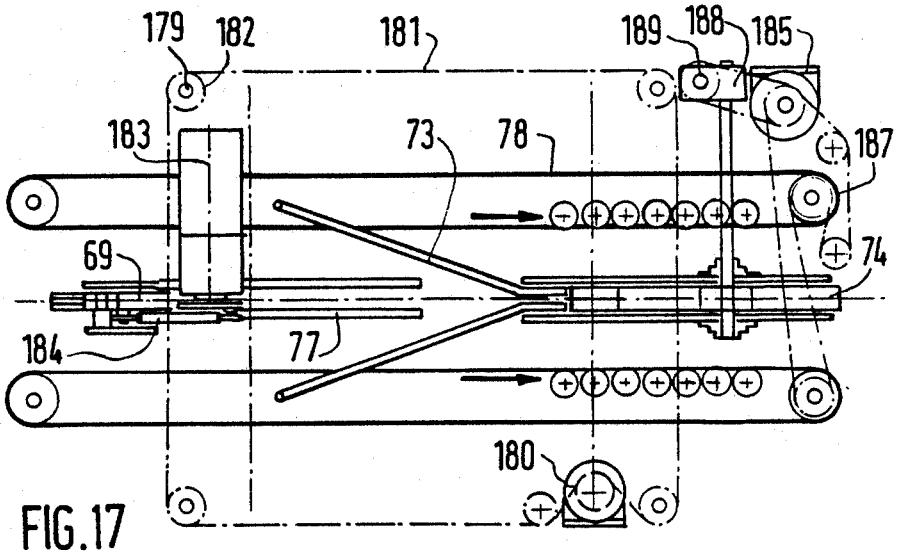
Figure 18:
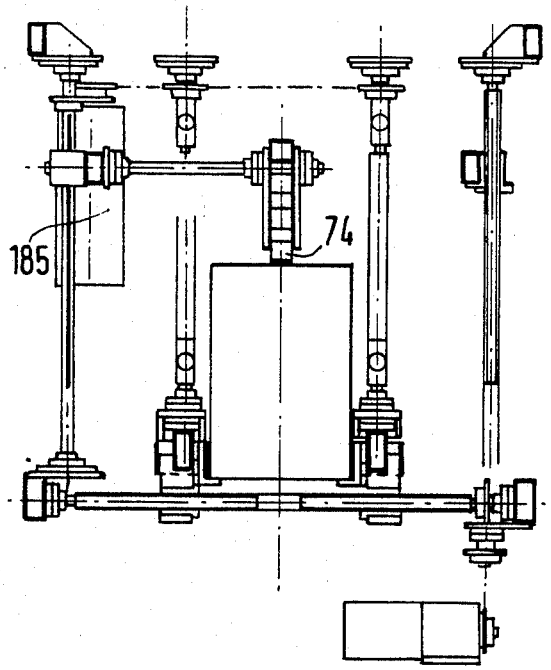
Figure 19:
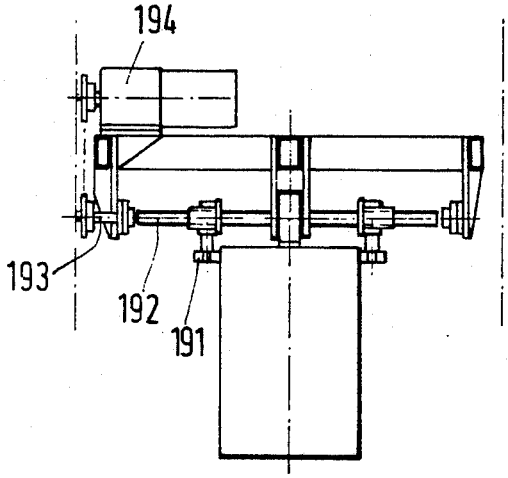

For example, means 42 can comprise three lines and four columns of jacks 45 (FIG. 4). However, the number of lines and/or columns of jacks can be different and adapted to obtain the desired accuracy in constructing the various dimensions of the various cooperating parts corresponding to the various box sizes under consideration.

Figure 3:
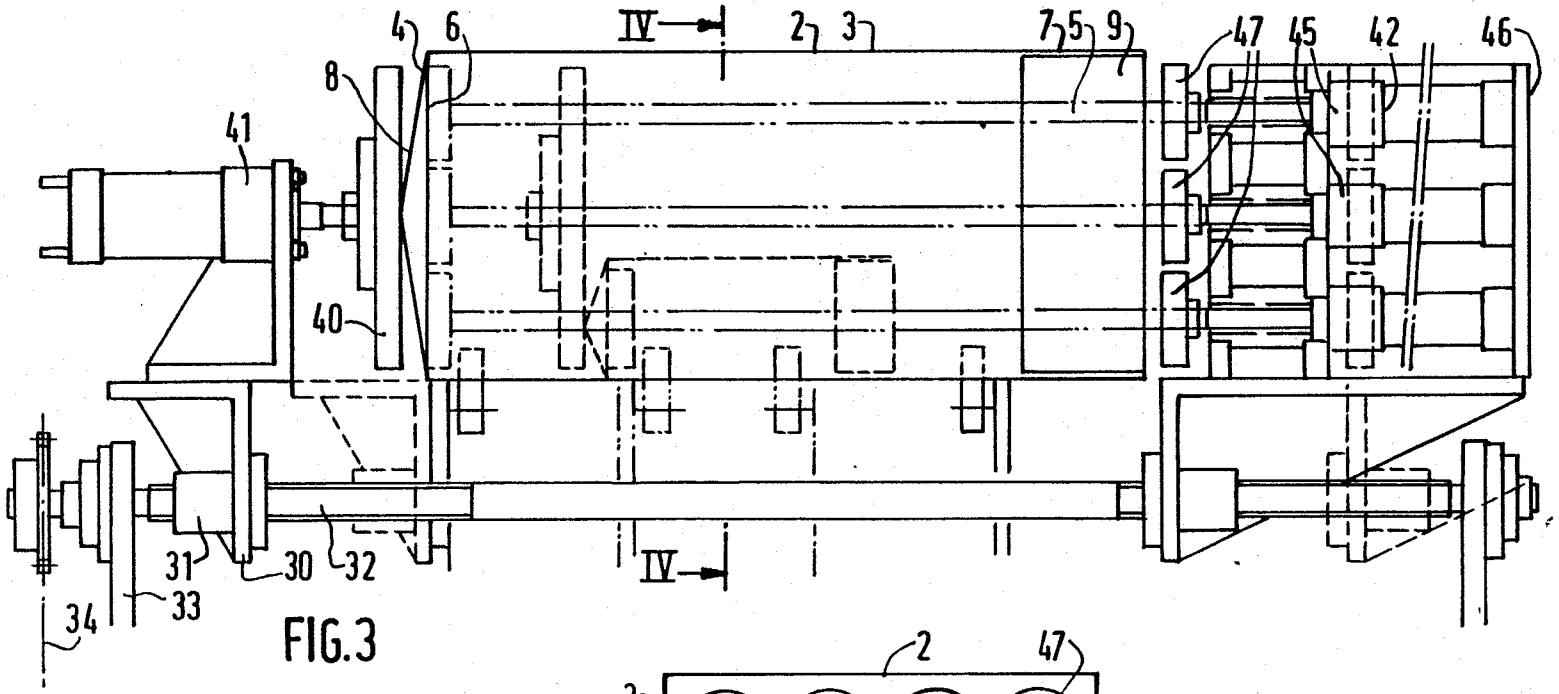
FIG. 3 is a larger-scale diagram in cross-section along line 3.3 in FIG. 2.

We now refer to FIGS. 3 and 4, which illustrate two possible extreme variants of box size. The first or largest size is shown by continuous lines whereas the second or smallest size is shown by a chain line. All the jacks 45 are operated for the first size whereas only one jack is operated for the second size. The two longitudinal members 30 are at their maximum and minimum spacing respectively for the two sizes (the first and the second). The operation of jacks 45 and the stroke thereof are actuated by the means for controlling machine 1.

Since a cooperating means 42 is constructed in the form of a selectively controlled matrix, the machine can be adapted to all box sizes and the flaps can be held from the interior in a particularly efficient manner, thus firmly securing the first and second flaps 4, 6 of base 5. The matrix of jacks 45 has dimensions defined by the largest size of box to be handled.

The jacks 45 in operation are used for moving the corresponding plates 47 between two end positions, i.e. a retracted position (FIG. 2 and continuous lines in FIG. 3) at a distance from the supply means 11 so as not to interfere with box 2, and an active operating position (chain-dotted lines in FIG. 2 for the first box variant) where plates 47 are disposed inside box 2 and press against the first flaps 6 and are consequently substantially in the same plane as plate 40.

As the preceding description shows, the two members 30 are moved simultaneously for the same distance but in opposite directions, so that boxes 2 moving along the supply means 11 stay in the same reference plane, i.e. the central vertical plane (of symmetry) of the machine. However, other embodiments are possible, e.g. the reference plane can be the plane of bottom 4.

The movable-lug supply means 11 comprise two portions in line, i.e. a first upstream portion extending between the first and the second reference positions 23, 24 and a second downstream portion extending between the second and third reference position 24, 25, thus enabling the boxes 2 to move from magazine 12 to each position in succession. The downstream portion also extends downstream so as to discharge the boxes on the supply means 11.

The machine has at least two fixed vertical transverse gantries 50 extending over the supply means 11 and respectively placed e.g. between the second and third reference positions 24, 25 and downstream of the third position 25 respectively. The horizontal, transverse top cross-members 51 of gantries 50 have central vertical bearings 52 for guiding threaded rods 53. Bearings 54 are borne by cross-members 51 so as to pivot around their vertical axes and comprise internal threads cooperating with the threaded rods 53 for sliding them and also comprise external driving teeth or the like. A chain 55 or the like drives bearings 54 in synchronism via the teeth. A motor (not shown) drives chains 55. The threaded rods 53 are disposed vertically and centrally. At least one longitudinal member 56, preferably two members (slightly spaced from one another) is secured to the bottom ends of the threaded rods 53. Member 56 is horizontal and above, e.g. in the middle, and is vertically movable but adjustably lockable in position by control means extending above the supply means 11, inter alia between the second reference position 24 and the downstream end of the supply means 11. Member 56 can be pressed against the top horizontal surface of the open box 2 without preventing it from sliding. Means 57 for squaring the box 2 are borne by the longitudinal member 56 opposite the vertical folding plate 40 and the plates 47 forming a cooperating device 42. The structure is therefore such that the plane of the supply means 11 is also a reference plane for boxes 2, since the squaring means 37 are moved to adjust them to the box size in question.

The squaring means 57 comprise an upstream lug or catch 58 for locking the upstream vertical transverse surface of box 2 at the top, in the same plane as the third reference position 25, and also comprise a movable lug 59 for urging the downstream vertical transverse surface of box 2 upwards and upstream, the lug being borne by a chain 60 driven by a jack 61 or the like to a locking position adjustable by automatic mechanical control means (e.g. a friction wheel) where the box is held perfectly squared between the bottom upstream lug of the supply means 11 and the two upper lugs 58, 59. The use of a friction wheel has the advantage of automatically adjusting the position of lug 59. Chain 60 and jack 61 are disposed above member 56 so as not to interfere with the open box 2. Lug 58 forms a catch so as to enable boxes 2 to move in the upstream-downstream direction. Lug 59 can be placed in a retracted inoperative position above member 56.

Downstream of the supply means 11, the packing machine 1 according to the invention can comprise means 48 for sliding and/or pivoting the box after it has been erected and opened by means 13, so as to transfer it to the discharge means 16 so that the box opening is placed either at the side or on top, depending on whether the packing machine is of the lateral or vertical packing kind.

The means 14 for supplying the contents 10 can be in the form of an endless belt comprising transverse retaining bars 49 for driving and grouping the contents 10 in successive structured batches.

The discharge means 16 also comprise one or more belt conveyors for driving the boxes 2 downstream, inter alia after they have been filled.

Machine 1 has at least two fixed vertical transverse gantries 62 extending over the discharge means 16 and having horizontal transverse top cross-members 63 comprising bearings 64 for guiding vertical threaded rods 65. Bearings 66 are pivotable around vertical axes on bearings 64 and comprise threads cooperating with and driving the threaded rods 65 and also comprise external drive teeth or the like. A chain 67 or the like driven by a motor (not shown) drives the bearings so that the threaded rods 65 are slid in synchronism. A top central longitudinal member 68 is secured to the bottom ends of rods 65 and is vertically movable but can be adjustably locked in position by digital control means extending above the discharge means 16. Member 68 bears firstly, in the upstream-downstream direction, an arm 69 pivoting around a horizontal transverse shaft 70 and driven by a jack 71 adapted to fold two first flaps 7 of lid 5; secondly, means 72 for sticking the first flaps 7 after folding; thirdly two fixed slopes 73 inclined downwards and downstream and from the exterior towards the interior, i.e. approaching one another and approaching the discharge means 16 in the direction of advance of boxes 2 and adapted to fold the two second flaps 8 of cover 5 when box 2 advances towards the discharge means 16; and finally and fourthly an endless belt 74 disposed horizontally and longitudinally and pressing against the second flaps 8 after being folded as described, i.e. pressing on the cover 5, which is driven forward by a motor 75 borne by member 68. The endless belt 74 holds the second flaps 8 pressed against the first flaps 7 for sufficient time for the adhesive to set after being distributed by the sticking means 72.

Arm 69 is movable between two end positions, i.e. an inoperative retracted position where it is horizontally placed at the top and at a distance from the box 2 which is placed below, and an operative position where it is placed in the general vertical descending direction with its bearing plane 76 horizontal. The same horizontal plane contains the end of the sticking means 72 and the endless belt 74. The sticking means 72 are disposed substantially vertically and downwards. A bearing plate 77 provided between arm 69 and the sticking means 72 is inclined upstream and horizontally and the first flaps 7 can slide on it. Plate 77, which is designed to prevent flaps 7 from moving after escaping from arm 69, is disposed immediately between arm 69 and the sticking means 72. The downstream bottom ends of slopes 73 are also situated in the previously-mentioned plane. In order effectively to secure the lid 5, the endless belt 74 extends for a suitable length depending on the speed of the belt and the time required for sticking.

The machine 1 also has two lateral endless belts 78 on either side of the discharge means 16 and pressing on the longitudinal sides 3 of boxes 2 and borne by movable adjustable longitudinal members 79 and horizontal transverse threaded rods 80 and disposed above the discharge means 16, the rods 80 being driven in rotation by a motor and chains so as to move the endless belts 78 together or apart depending on the box 2 under consideration.

The various motors described with respect to means 13 and means 17 and the motors in the transverse means 15 or associated with the endless belt 78 are actuated by the previously-mentioned digital control means.

Of course, the preceding description relates to only one possible embodiment of the invention, and other embodiments are also possible.

We shall now, with reference to FIGS. 5–19, describe a practical embodiment of FIG. 1 substantially according to the basic embodiment described previously.

The supply means 12 are adjustable. To this end, rails 26 are perpendicularly borne by two arms 81 inclined at about 45° to the horizontal in the downstream direction and upwards, the arms being held by two bearing members 82 extending longitudinally and laterally and adjustably spaced and, in vertical elevation, having a generally angular shape comprising a horizontal portion and a vertical portion borne by two threaded horizontal, transverse rods upstream and downstream respectively (83 and 84) each having two opposite screw threads and respectively cooperating with threaded bearings of members 82, at the upstream end of the horizonal portions near the place of connection to arms 81 in the one case, and at the bottom end of the vertical portions in the other case. Toothed pulleys 85, 86 keyed to rods 83, 84 engage an endless chain 87 driven by a motor 88 forming a fixed assembly. Bearings 89 on the frame 18 hold the threaded rods 83 and 84.

As is clear from the aforementioned structure, the rails 26 of magazine 12 are adjustably spaced in equal manner corresponding to the spacing of two longitudinal lateral horizontal slide bars 90 extending along that part of machine 1 where box 2 is erected and its bottom 4 is made rigid (with means 48). Slide bars 90 are right-angled in right cross-section and serve the double purpose of forming a bearing plane and laterally guiding the boxes 2 or the constituent blanks thereof.

In the present embodiment, the means (a movable lug) for transferring the blanks successively and to the magazine unit 12 as far as the supply means 11 comprise a central longitudinal arm 91 disposed between the slide bars 90 (or alternatively a number of arms side by side) and axially keyed and free to rotate on the upstream threaded rod 83, which forms a pivot. Arm 91 is integral with a link 92 at approximately 120° extending backwards and upstream when arm 91 is horizontal and inoperative. Link 92 is jointed to the end of a rod 93 which is jointed at its other end to the end of a lever 94, the centre of which is freely pivotable around the downstream threaded rod 84 whereas the other end of the lever is jointed to the end of a link 95 which at its other end is jointed to the end of a lever 96 pivotable at its other end around a horizontal transverse fixed shaft 96 disposed at the bottom of machine 1 substantially between the means for opening box 2 and the means for finally constructing the bottom 4, i.e. between positions 24 and 25. At its centre, lever 46 has a catch or the like cooperating with a cam 98 mounted on a horizontal transverse fixed shaft 99 likewise disposed at the bottom of machine 1, inter alia downstream of shaft 97. Arm 91 has a number of suckers. If necessary, means are provided for successively actuating those suckers near the threaded rod 83 while not actuating those suckers at a distance, depending on the size of the blank to be transferred. Arm 91 is movable between two positions—a horizontal position extending downstream and an inclined extraction position corresponding to magazine 12, inter alia from upstream to downstream and upwards at approximately 60°.

As previously mentioned, the supply means are preferably of the movable drive lug kind. More specifically, three or four sets of lugs are provided, i.e. a first lug 100 between the upstream position 23 and the intermediate position 24, a second lug 101 between the intermediate position 24 and the final position 25, and a third lug 102 between the final position 25 and the area of means 48, i.e. when the box 2 has been made up. Preferably, pairs of lugs 100, 101, 102 are provided near the slide bars 90. Lug 100 is borne by a first slide 103 and lugs 101 and 102 by a second slide 104. Slides 103 and 104 are mounted for horizontal longitudinal sliding on one or usually two horizontal longitudinal rails 105 on which the slide runners 106 move and are guided.

A link 107 connects the two slides 103, 104 which are spaced apart by a fixed distance so as to move in synchronism. Slides 103, 104 are slid alternately upstream and downstream inter alia by a link 107 and a cam 108 mounted on shaft 99 and driving a rod 109 jointed at its other end to the central part of a lever 110 jointed at its first bottom end to a stationary bottom transverse horizontal shaft 111 on machine 1, disposed approximately in vertical alignment with magazine 12, and jointed at its second and top end to a guide link 112 which in turn is jointed to slide 103. Lever 110 is moved between two end positions, each at about 45° to the horizontal, in the upstream and downstream direction respectively.

Lugs 100, 101, 102 are also borne by members jointed to the respective slides 103, 104 around respective shafts 113, 114 and 115. A horizontal longitudinal rail 116 is disposed below shafts 113, 114 and 115. Preferably two lateral rails are provided. Rail 116 is vertically slidable by a suitable device such as a deformable parallelogram of links 117 driven by drive means such as a cam 118 keyed to shaft 99 and, via a crank pin 119 jointed to shaft 97, driving a substantially horizontal longitudinal link 120 jointed at its opposite end to a number of links (general reference 121) jointed to one another and to the deformable link parallelogram 117. Rollers 122, 123 borne by links 124, 125 respectively are mounted in the rail 116 forming a slide rod and are jointed to shafts 113, 114 respectively and rigidly associated to the members of lugs 100 and 101 respectively. A guide link 126 [is] jointed to the two members of lugs 101, 102 so as to rotate them in synchronism and in opposite directions. Lugs 100 and 101 pivot synchronously and in the same direction. Rail 116 is movable between a top and a bottom end position in which lugs 100, 101 and 102 are respectively in the projecting operative position and in the retracted inoperative position, with respect to the reference plane comprising slide bars 90. This enables lugs 100, 101 and 102 to move forward downstream in the operative position and return upstream in the inoperative position.

As previously stated, lugs 100, 101, 102 are preferably in pairs and disposed at the side in order more efficiently to hold the box 2 and are adjustably spaced transversely so as to grip the box nearer its sides, thus improving guidance. To this end, the lugs are mounted for axial sliding along splined shafts such as 195, via complementary splined sleeves 196 cooperating with shafts 195. A grooved roller 197 rigidly associated with sleeve 196 is likewise mounted on and around the splined shaft 195. A longitudinal projection 198 forming a rail cooperates with the groove of roller 197. Projection 198 is adjacent and integral with and mechanically connected to one of the longitudinal members 30. Shafts 195 are pivotably mounted. They are movable by sliding transversely (relative to their axis) and longitudinally (relative to the machine). The rail-forming projections cause sleeves 196 to slide axially and thus transversely adjust the lugs.

The arm 28 bearing the sucker 29 for opening the box 2 is driven by a link 127 which is jointed to it and is actuated by a cam 128 keyed to shaft 99. For example, cam 128 via a catch or the like drives a crank pin 129 pivoted to shaft 97 at its bottom end and jointed at its top end to a substantially horizontal longitudinal link 130 around a shaft 132 jointed to link 127. By this means, arm 28 can pivot through 90° between a horizontal end position facing downstream and a vertical ascending end position.

Preferably, one or more suckers 133 are also provided pressing against and holding the bottom horizontal side of box 2 when opened for erecting . The sucker or suckers 133 are axially vertical and directly or indirectly borne by a substantially vertical arm 134 and guided by guide means such as a sleeve 135 vertically slid by a link 136 actuated by a cam 137 keyed to shaft 99, link 136 also being pivoted around a stationary bottom transverse horizontal shaft 135 disposed approximately below and in vertical alignment with the third final postion 25. By means of this structure, the sucker or suckers 133 are movable between a top active working position and a bottom inactive retracted position.

Arms 35, 36 are also driven around their axes 37, 38 by two cams 139, 140 keyed to shaft 99 by a suitable linkage. It is stressed that axes or shafts 37, 38 are vertical and the horizontal shaft 99 is transverse. For example, cam 139 actuates a crank pin 141 pivotably mounted on shaft 97, on which a link 142 is pivoted at one end. Link 142, which is substantially horizontal, is pivoted at its other end to the end of a lever 143 pivoted at its centre around a horizontal transverse shaft 144 disposed at least substantially in vertical alignment with magazine 12. The other end of lever 143 is pivoted to a rod 145 pivoted to a link 146 which is integral with arm 35 and consequently pivotably mounted around shaft 37. Rod 145 is pivoted to lever 143 around a horizontal shaft and to link 146 around a vertical shaft. A similar structure is provided in the case of cam 140 and arm 36, i.e. crank pin 147, rod 148, lever 149, rod 150 and link 151. Lever 149 is pivoted around shaft 144. A lever-and-link guide device 152 is interposed between rod 150 and link 151.

A single motor 153 with a motor and reduction gear and a bevel gear is disposed at the bottom of the machine and borne by frame 18, inter alia substantially in vertical alignment with the final position 25, and drives shaft 99 and consequently cams 98, 108, 118, 128, 137, 139 and 140. Shaft 99 is borne by bearings 154.

In the downstream part for making up and securing the bottom 4, machine 1 comprises two bars 155 instead of plate 40. Bars 155 extend horizontally and longitudinally and are borne by two arms 156 (or pairs of arms) pivoted around horizontal longitudinal shafts 157 in a single vertical plane and near one another. The assembly 155, 156 and 157 forms a gripping means extending axially and opening and closing. Shafts 157 are borne by a slide 158 mounted for vertical sliding on two vertical threaded columns 159 cooperating with the threads in slide 158 and disposed in a single longitudinal vertical plane. Columns 159 are in turn supported at the bottom by the corresponding longitudinal member 30, and at the top by a horizontal longitudinal upper cross-member 160 kept at a fixed spacing by horizontal transverse rods or the like 161 of another horizontal longitudinal upper cross-member 162 which is coplanar with cross-member 160 but on the opposite side of the machine. Member 162 bears two vertical columns 163 placed opposite columns 159 but on the other side of the machine. Columns 163 in turn are borne by one or more slides 164 guided by sliding in the horizontal transverse direction on rollers 165 on horizontal transverse slide bars 166 permanently mounted on frame 18. Two other threaded columns 167 near columns 163 extend vertically and are borne between and by the slide or slides 164 and cross-member 162. Toothed wheels 168 keyed to the projecting top edges of columns 159 and 167, which are connected by an endless chain 169 or any equivalent means associated with a motor 170 to be described hereinafter, are used for driving the threaded columns 159, 167 synchronously and in the same direction. A slide 171 is mounted on columns 167 via suitable screw-threading, slide 171 being horizontally placed in the same plane as but opposite slide 158. Slide 171 bears the cooperating means 42. Consequently, the two slides 158, 171 are moved synchronously and are horizontally and tranversely at a constant distance from one another. The spacing is maintained by one or more bottom transverse horizontal rods 172 in addition to rods 161.

Means such as jacks are adapted to open and close the gripping means 155, 156, 157.

In the present embodiment, the cooperating means 42 comprise a single line of jacks 45 disposed in a horizontal plane and adapted to press the bottom of box 2 on the inside in its central area, opposite and against the two arms 156 which are brought towards one another, the corresponding gripping means being closed. A change in size of box 2 is taken into account by jacks 45 only if there is a change in horizontal length, when the number of jacks in operation is adjusted accordingly. As a result of the aforementioned structure comprising rods 161 and 172, the travel of jacks 45 is constant irrespective of the size of box 2 (in the transverse direction).

In the present embodiment, the cross-member 56 is borne by a top horizontal frame 173 vertically slidable on four vertical threaded columns 174 having stationary axes and mounted on the machine frame 18. Columns 174 are actuated, inter alia via rear wheels, by chains or the like so as to rotate synchronously in the same direction. According to the invention the threaded columns 174 are driven by the same motor 170 as the threaded columns 159 and 167, but with a reduction gear so that the distance over which the frame 172 slides is twice the travel of slides 158 and 171 or the travel of slides 158 and 171 is half that of frame 173. To this end, motor 170 can be axially vertical and disposed in the bottom part of the machine, forming a fixed assembly on the side of the machine and driving the columns 159, 167 via a toothed wheel 175 identical with the wheel 176 driving the threaded columns 174. The toothed wheel 176 has a stationary vertical axis and is borne by frame 18. Allowing for the motion of the threaded columns 159, a universal joint 177 is provided between columns 159 and the shaft of wheels 175. As shown by the preceding description of the basic embodiment, the longitudinal members 30 are mounted for sliding horizontally and transversely in opposite directions and in synchronism, via threaded rods 32 and a motor 178 and bear slide bars 90.

As the preceding shows, the transverse movements of longitudinal members 30 and consequently of lugs 100, 101, 102 is independent of but combined with the relative motion of jacks 45, and hence the existence of slide 171. The threaded columns 159 and 167 rotate twice as slowly as the threaded columns 174 and in addition the vertical axes of columns 159 and 167 are horizontally and transversely movable whereas the axes of columns 174 are stationary, and for this reason the frame 173 is made wider than the frame of columns 159 and 167 in their various positions. The gripping means 155, 156, 157 occupies a relative transverse position which is stationary relative to the corresponding longitudinal member 30 and is thus permanently in the same position relative to the bottom 4 of box 2 irrespective of its size.

We shall now consider the discharge part of machine 1. Longitudinal member 68 is directly mounted on four axially vertical threaded columns 179 supported at the base by frame 18. Columns 179 are driven by a motor and reduction gear 180 via a chain 181 and toothed wheels 182. Arm 69 is driven by a motor and reduction gear 183 and a crank shaft 184, instead of a jack. The bearing plate 77 continues downstream beyond the sticking means 72, up to and under the central part of slopes 73. A single motor and reduction gear 185 borne by the machine frame in a stationary position drives the endless belt 74 via an axially horizontal drum 186 and also drives the lateral endless belts 78 via identical axially vertical drums 187. To this end, the motor and reduction gear 185 is associated with drum 186 by a sliding bevel gear 188 on a keyed shaft 189, and is associated with drums 187 by sliding universal-joint gears 190. Finally, rollers 191 are provided for laterally holding the box at the top, and are axially vertical and borne by two longitudinal horizontal supports which in turn are borne by transverse threaded rods 192 via bearings 193 borne by the longitudinal member 68. A motor and reduction gear 194 also borne by member 68 is for driving the threaded rods and consequently adjusting the rollers 191.

I claim:

1. A packing machine for American boxes formed from box blanks having four sides, a bottom, and a lid, the lid being formed by a pair of first lid flaps and a pair of second lid flaps and the bottom being formed by a pair of first bottom flaps and a pair of second bottom flaps, comprising:

first and second shafts;

a magazine of stacked box blanks folded flat;

erecting means for opening and erecting the box and forming the bottom thereof by folding and securing the pairs of first and second bottom flaps, said erecting means being slidably but lockably mounted on said first shaft;

box-supplying means for supplying empty boxes, said box-supplying means having an upstream end and a downstream end and bearing, in the upstream-downstream direction, said magazine and said erecting means;

contents-supplying means for supplying the contents of the box in batches suitable for packing;

contents-transferring means for transferring the batches of contents and placing them in the opened and erected boxes, said contents-transferring means being interposed between the downstream parts of said box-supplying means and said contents-supplying means and comprising a robot having three degrees of freedom, whereby the boxes can be filled either vertically or from the side;

lid-making means for making up the lid by folding and securing the pairs of first and second lid flaps, said lid-making means being slidably but lockably mounted on said second shaft;

discharging means for discharging the boxes and bearing, in the upstream-downstream direction, said contents-transferring means and said lid-making means;

drive means permanently incorporated in said machine, said erecting means and said lid-making means being simultaneously movable by said drive means; and digital control means associated with said drive means for controlling said drive means.

2. The machine of claim 1, said drive means comprising rotatable threaded rods and motors for rotatably driving said rods.

3. The machine of claim 1, said digital control means comprising manual display means for displaying the size of the boxes and automatic programmable means associated with said manual display means and said drive means for moving said drive means depending on the adjustment of said display means until said erecting means and said lid-forming means are brought into positions corresponding the chosen size of the boxes.

4. The machine of claim 1, said box-supplying means at said downstream end comprising box-transferring means for sliding and pivoting the erected and opened box and transferring it to said discharging means, whereby the opening of the box is placed at the top or the side.

5. The machine of claim 1, further comprising:

a machine frame for bearing said box-supplying means, said magazine, said erecting means, said contents-supplying means, said contents-transferring means, said discharging means, and said lid-making means;

first and second horizontal lateral longitudinal members movable horizontally and transversely but lockable and adjustable and extending parallel to and on either side of said box-supplying means, said first and second longitudinal members being provided with first and second bearings, respectively, disposed in said machine frame;

first and second arms mounted on said first longitudinal member bearing in the upstream direction and adapted to fold the pairs of first and second bottom flaps;

adhering means mounted on said first longitudinal member bearing in the upstream direction for adhering the pairs of first and second bottom flaps;

first, second, third, and fourth vertical folding plate means mounted on said first longitudinal member bearing in the upstream direction for folding the pairs of first and second lid flaps;

movable cooperating means mounted on said second longitudinal member opposite said first, second, third, and fourth vertical folding plate means for cooperating with the pairs of first and second lid flaps inside the box;

at least first and second threaded rods cooperating, respectively, with said first and second threaded bearings; and at least one rod-driving motor and a rod-driving chain drivingly connecting said at least one rod-driving motor to said threaded rods, said at least one rod-driving motor being actuated by said control means.

6. The machine of claim 5, said movable cooperating means comprising a plurality of juxtaposed jacks disposed in a matrix having at least one line and at least one column, each of said jacks comprising an elementary cooperating plate, said jacks being actuated by said control means, only those of said jacks whose elementary cooperating plates can extend into the box in question being operative.

7. The machine of claim 6, said matrix of jacks being defined by the largest size of boxes to be processed.

8. The machine of claim 5, further comprising:

third and fourth threaded rods;

first and second fixed vertical transverse gantries extending over said box-supplying means, each of said gantries having a top cross member, said top cross members comprising guide bearings for guiding said third and fourth threaded rods, and said top cross members bearing drive bearings, said drive bearings including internal threads cooperating with said third and fourth threaded rods;

a bearings-driving motor and a bearings-driving chain having teeth drivingly connecting said bearings-driving motor with said drive bearings in synchronism;

at least one central upper horizontal longitudinal sliding member movable vertically but lockable and extending above said box-supplying means, said sliding member being adapted to press against the upper horizontal surface of the box without preventing the box from sliding; and squaring means borne by said sliding member opposite said first folding plate means and said movable cooperating means.

9. The machine of claim 8, said squaring means comprising an upstream locking catch for locking the upstream vertical transverse surface of the box at the top and a movable lug for urging the downstream vertical transverse surface of the box upwards and upstream, said movable lug having a locking position and said machine further comprising:

a longitudinal chain bearing said movable lug and a jack means for driving said longitudinal chain and said movable lug to said locking position, said jack means being actuated by said control means.

10. The machine of claim 1, said box-supplying means and said discharge means being disposed substantially in line with and in continuation of one another, said contents-supplying means being disposed alongside said discharging means.

11. The machine of claim 1, further comprising:

at least two threaded rods, each of said at least two threaded rods having a top end and a bottom end;

at least two drive bearings, said drive bearings including internal threads cooperating with said at least two threaded rods;

at least two transverse vertical stationary gantries extending over said discharging means, each of said gantries having a top cross member, said top cross members comprising guide bearings for guiding said at least two threaded rods, and said top cross members bearing said drive bearings;

a motor and a chain having teeth cooperating with said drive bearings for drivingly connecting said motor to said drive bearings in synchronism;

a horizontal shaft;

an arm movable between an operative position and an inoperative position and pivoting around said horizontal shaft and adapted to fold the pairs of first and second lid flaps;

adhering means for adhering the pairs of first and second flaps;

two fixed slopes approaching one another and approaching said discharging means in the direction of advance of the boxes and adapted to fold the pair of second lid flaps after the boxes have advanced on said discharging means;

an endless holding belt coplanar with said arm in said operative position and with said adhering means and adapted to hold the pair of second lid flaps pressed against the pair of first lid flaps for sufficient time for the adhesive to set; and a central upper longitudinal sliding member movable vertically but lockable and secured to said bottom ends of said at least two threaded rods, said sliding member bearing in the downstream direction said arm, said adhering means, said two fixed slopes, and said holding belt.

12. The machine of claim 11, further comprising:

first and second adjustably spaced lateral endless pressing belts positioned on either side of said discharging means, said endless belts pressing against the longitudinal sides of the box;

third and fourth threaded rods cooperating with said endless belts, said third and fourth threaded rods being driven in synchronism with said discharge means; and first and second longitudinal members respectively supporting said third and fourth threaded rods.

13. The machine of claim 1, said magazine comprising a plurality of guide rails, first and second arms supporting said guide rails, first and second bearing members having threaded bearings and holding said first and second arms, said bearing members extending longitudinally and laterally and being adjustably spaced, an upstream horizontal threaded rod and a downstream horizontal threaded rod respectively bearing said arms and said bearing members, each of said horizontal threaded rods having opposite screw threads and respectively cooperating with said threaded bearings of said bearing members, and a rod-driving motor drivingly connected to said horizontal threaded rods, forming a fixed assembly.

14. The machine of claim 13, further comprising first and second longitudinal, lateral, horizontal slide bar means extending along said erecting means for forming a bearing plane and laterally guiding the boxes or the blanks for forming the boxes, said slide bar means having a right-angled right cross-section.

15. The machine of claim 14, further comprising blank-transferring means for successively transferring the blanks to said magazine as far as said box-supplying means, said blank-transferring means comprising at least one horizontal arm disposed between said slide bar means and axially keyed and freely rotatable on said upstream horizontal threaded rod to form a pivot shaft, a first linkage cooperating with said at least one horizontal arm, and a first cam cooperating with said first linkage.

16. The machine of claim 4, said box-supplying means having a reference axis having a fixed first upstream initial position, a fixed second intermediate opening position, and a fixed final position, said machine further comprising:

a first lug between said upstream position and said intermediate position, a second lug between said intermediate position and said final position, and a third lug between said final position and the area of said box-transferring means;

first and second slides, said first slide bearing said first lug and said second slide bearing said second and third lugs;

at least one horizontal longitudinal rail, said slides being mounted for longitudinal horizontal sliding on said at least one rail; and a link connecting said slides, said slides being spaced from one another by a fixed distance whereby they move in synchronism.

17. The machine of claim 16, further comprising a second cam and a second linkage drivingly connecting said slides with said second cam for alternatingly sliding said slides upstream and downstream.

18. The machine of claim 16, further comprising:

third, fourth, and fifth shafts;

pivotable members pivotably mounted on said slides around said respective third, fourth, and fifth shafts, said pivotable members bearing said first, second, and third lugs;

a horizontal longitudinal rail disposed below said third, fourth, and fifth shafts;

a deformable parallelogram of links, said rail being vertically slidable on said parallelogram of links; and a second cam and a second linkage drivingly connecting said parallelogram of links to said second cam.

19. The machine of claim 17, further comprising:

third, fourth, and fifth shafts;

pivotable members pivotably mounted on said slides around said respective third, fourth, and fifth shafts, said pivotable members bearing said first, second, and third lugs;

a horizontal longitudinal rail disposed below said third, fourth and fifth shafts;

a deformable parallelogram of links, said rail being vertically slidable on said parallelogram of links; and a third cam and a third linkage drivingly connecting said parallelogram of links to said third cam.

20. The machine of claim 1, further comprising:

at least one sucker adapted to be pressed on and to hold the bottom horizontal side of the box when opened for erection by said erecting means;

a substantially vertical arm bearing said at least one sucker;

vertically slidable guide means for guiding said vertical arm; and a cam and a linkage drivingly connecting said guide means with said cam.

21. The machine of claim 5, said first and second arms having first and second axes, respectively, and said machine further comprising first and second cams and first and second linkages for drivingly connecting said first and second cams, respectively, to said first and second arms, respectively, said first and second arms being driven around said first and second axes.

22. The machine of claim 15, further comprising a horizontal transverse fixed shaft, said first cam being rotatably mounted on said fixed shaft, and a single shaft-driving motor disposed at the bottom of said machine, said fixed shaft being driven by said shaft-driving motor.

23. The machine of claim 8, further comprising:

third and fourth horizontal longitudinal shafts, third and fourth arms jointed respectively around said third and fourth shafts in a single vertical plane near one another, and first and second horizontal longitudinal bars borne by said third and fourth arms, respectively, said third and fourth shafts, said third and fourth arms, and said first and second bars forming an axially extended gripping means;

a plurality of horizontal transverse rods;

first and second horizontal longitudinal upper cross members, said first and second upper cross members being coplanar and held at a fixed spacing from one another on opposite sides of said machine by said plurality of transverse rods;

first and second vertical threaded columns respectively supported at the bottom by said first and second longitudinal members and at the top by said first upper cross member;

a first slide mounted for vertical sliding movement on said first and second columns;

a plurality of horizontal transverse slide bars fixed to said machine frame;

a plurality of rollers mounted on said plurality of slide bars;

a second slide slidingly guided in the horizontal transverse direction by said plurality of rollers;

third and fourth vertical columns respectively supported at the bottom by said second slide and at the top by said second upper cross member;

fifth and sixth threaded columns near said third and fourth columns extending vertically and respectively supported at the bottom by said second upper cross member and at the top by said second slide;

a column-driving motor for synchronously driving said first and second and fifth and sixth columns in the same direction;

a third slide threadably mounted on said fifth and sixth columns, said third slide being horizontally disposed in the same plane as but opposite said first slide and bearing said movable cooperating means, whereby said first and third slides are moved in synchronism and are horizontally and transversely at a constant distance from one another.

24. The machine of claim 23, further comprising:

a central upper longitudinal sliding member;

seventh, eighth, ninth, and tenth vertical threaded columns having fixed axes, said seventh, eighth, ninth, and tenth columns being mounted on said machine frame and driven by said column-driving motor;

a top horizontal frame vertically slidable on said seventh, eighth, ninth, and tenth columns, said longitudinal sliding member being supported by said top horizontal frame; and reduction gear means drivingly connecting said column-driving to said seventh, eight, ninth, and tenth columns for making the sliding travel of said top horizontal frame twice that of said first and third slides.

25. The machine of claim 11, further comprising:

a machine frame for bearing said box-supplying means, said magazine, said erecting means, said contents-supplying means, said contents-transferring means, said discharging means, and said lid-making means;

first, second, third, and fourth axially vertical threaded columns supported by said machine frame, said longitudinal sliding member being mounted on said first, second, third, and fourth columns; and a column-driving motor and a column-driving reduction gear drivingly connecting said column-driving motor to said first, second, third, and fourth columns.

26. The machine of claim 11, further comprising:

an arm-driving reduction gear, a crank shaft drivingly connecting said arm-driving reduction gear to said arm, and a n arm-driving motor, said arm-driving reduction gear drivingly connecting said arm-driving motor to said crank shaft.

27. The machine of claim 11, further comprising a bearing plate extending downstream beyond said adhering means to below the central part of said slopes.

28. The machine of claim 12, further comprising:

a machine frame for bearing said box-supplying means, said magazine, said erecting means, said contents-supplying means, said contents-transferring means, said discharging means, and said lid-making means;

a keyed shaft and a bevel gear slidingly mounted on said keyed shaft;

a pair of sliding universal joint gears;

a single belt-driving motor and a belt-driving reduction gear drivingly connecting said bevel gear and said universal joint gears to said belt-driving motor, said belt-driving motor and said belt-driving reduction gear being borne by said machine frame in a fixed position;

and axially horizontal drum drivingly connecting said holding belt to said bevel gear; and first and second identical axially vertical drums respectively drivingly connecting said first and second pressing belts to said universal joint gears.

29. The machine of claim 11, further comprising:

a plurality of roller means for laterally holding the top of the box, said roller means being axially vertical;

two longitudinal horizontal supports supporting said roller means;

a plurality of transverse threaded rods supporting said longitudinal horizontal supports;

a plurality of bearings connecting said plurality of transverse threaded rods to said longitudinal member; and a rod-driving motor and a rod-driving reduction gear drivingly connecting said rod-driving motor to said plurality of transverse threaded rods for adjusting the roller.

30. The machine of claim 16, further comprising:

first and second horizontal lateral longitudinal members horizontally and transversely but lockable and adjustable and extending parallel to and on either side of said box-supplying means;

a plurality of longitudinal projections adjacent said longitudinal member;

a plurality of splined shafts;

a plurality of splined sleeves respectively slidingly mounted on said splined shafts, said plurality of splined sleeves slidingly mounting said first, second, and third lugs on said plurality of splined shafts; and a plurality of grooved rollers respectively mounted on and around said splined shafts and cooperating with said plurality of longitudinal projections, whereby said first, second, and third lugs are in pairs at an adjustable transverse spacing.

* * * * *